United States Patent [19]

Holleboom

[11] 4,050,425

[45] Sept. 27, 1977

[54] AIR-FUEL RATIO CONTROL SYSTEM

[75] Inventor: Bruce W. Holleboom, Grand Blanc, Mich.

[73] Assignee: General Motors Corporation, Detroit, Mich.

[21] Appl. No.: 634,605

[22] Filed: Nov. 24, 1975

[51] Int. Cl.[2] ..... F02M 7/00; F02M 13/04

[52] U.S. Cl. ..... 123/119 EC; 123/32 EE; 123/119 R; 123/122 AB; 123/124 R; 261/39 R

[58] Field of Search ..... 123/119 E, 119 EC, 119 EE, 123/119 R, 119 D, 124 R, 32 EH, 32 EE, 122 AB; 60/276; 204/195 S; 261/DIG. 74, 39 R, 39 A

[56] References Cited

U.S. PATENT DOCUMENTS

| | | | |
|---|---|---|---|
| 2,355,090 | 8/1944 | Love et al. | 123/119 E |
| 3,404,836 | 10/1968 | Hickam | 236/15 |
| 3,616,274 | 10/1971 | Eddy | 123/119 E |
| 3,738,341 | 6/1973 | Loos | 123/119 E |
| 3,791,936 | 2/1974 | Pebler et al. | 204/1 T |
| 3,825,239 | 7/1974 | Rice | 123/119 E |
| 3,828,747 | 8/1974 | Nambu | 123/122 G |
| 3,841,283 | 10/1974 | Wood | 123/119 R |
| 3,847,778 | 11/1974 | Riddel | 204/195 S |
| 3,874,171 | 4/1975 | Schmidt et al. | 60/276 |
| 3,885,540 | 5/1975 | Stadler | 123/119 A |
| 3,949,723 | 4/1976 | Beesch | 123/122 G |

*Primary Examiner*—Wendell E. Burns
*Attorney, Agent, or Firm*—Ronald L. Phillips

[57] ABSTRACT

An air-fuel ratio control system for an internal combustion engine supplies a very small sample of the air-fuel mixture being inducted to an air-fuel ratio sensor. A heater heats the sensor and also heats and ignites the air-fuel mixture sample at the sensor. A fuel system control controlled by the sensor then adjusts the air-fuel ratio of the mixture being inducted into the engine to the stoichiometric value.

2 Claims, 2 Drawing Figures

AIR-FUEL RATIO CONTROL SYSTEM

This invention relates to an air-fuel ratio control system and more particularly to such a system that operates by sampling the mixture being inducted.

It is currently common practice to simultaneously reduce HC, CO and $NO_x$ from an internal combustion engine in an automobile by passing the exhaust gases over a "three-way" catalyst which converts these undesirables to acceptable by-products. And for this type of catalyst to work best, it requires that the engine air-fuel ratio be held at the stoichiometric point or value. The stoichiometric point or value may be defined as that air-fuel ratio at which just enough combustibles and just enough oxygen are available to combine into the combustion products with no residual excess of any constituent. One known method of controlling the air-fuel ratio which has been used extensively involves arranging a sensor in the exhaust stream and sending a signal from this sensor to the fuel control system to hold the air-fuel ratio at the stoichiometric value. However, it has been found that because of the transport lags from the fuel controller (carburetor, etc.) through the engine to the sensor, this type of system has a tendency to oscillate or limit cycle unless transient response and/or gain is substantially reduced. Furthermore, the sensors used in this type of system are generally of the zirconium dioxide oxygen cell type which require a minimum operating temperature of several hundred degrees Fahrenheit for operation. In a typical system of this type the heat is normally provided by the exhaust gas and as a result, a considerable heat-up time can elapse after a cold start before the sensor becomes active and the closed loop system exercises the desired control.

The present invention is directed to rectifying both of these problems and in a preferred embodiment comprises an air-fuel ratio sensing unit of the zirconia cell type to which is delivered a very small sample of the air-fuel mixture being inducted into the engine. An electrically powered heater heats the zirconia cell and also heats and ignites the air-fuel mixture sample delivered to the cell with the products of combustion therefrom then delivered to the mixture being inducted into the engine. A fuel control system controlled by the air-fuel ratio sensor then operates to adjust the air-fuel ratio of the mixture being inducted into the engine to the stoichiometric value. Thus, by sensing at the inlet to the engine rather than at the exhaust, the transport lags are substantially reduced and by the use of the electrically powered heater the warm-up time to obtain the desired air-fuel ratio sensing operation is substantially reduced.

An object of the present invention is to provide a new and improved air-fuel ratio control system for an internal combustion engine.

Another object is to provide an air-fuel ratio control system for an internal combustion engine which senses the air-fuel mixture being inducted and accordingly adjusts the air-fuel ratio to the stoichiometric value.

Another object is to provide an air-fuel ratio control system for an internal combustion engine which combusts a very small sample of the air-fuel mixture being inducted and then senses the products of this combusted sample with a zirconia cell to adjust the air-fuel ratio of the mixture being inducted to the stoichiometric value.

These and other features and objects of the present invention will be more apparent from the following description and drawing in which.

Figure 1:
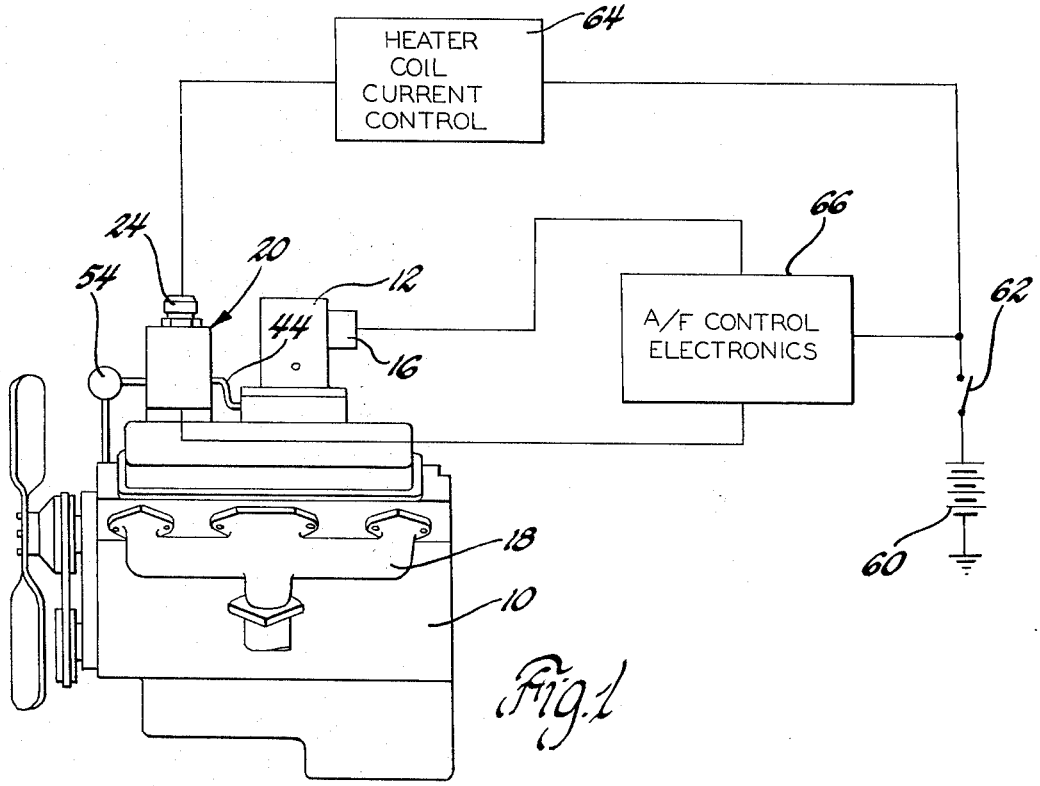
FIG. 1 is a diagrammatic view of a preferred embodiment of the internal combustion engine air-fuel ratio control system according to the present invention.

Referring to the drawing, a preferred embodiment of the present invention is shown in use on an internal combustion engine 10 of conventional type having an induction system 12 with a throttle valve 14 in an induction passage 15. The air-fuel ratio is controlled by a fuel control system 16 associated therewith which delivers a controlled fuel flow to the induction passage through a nozzle 17 and the products of combustion are delivered from the engine to an exhaust system 18.

Figure 2:
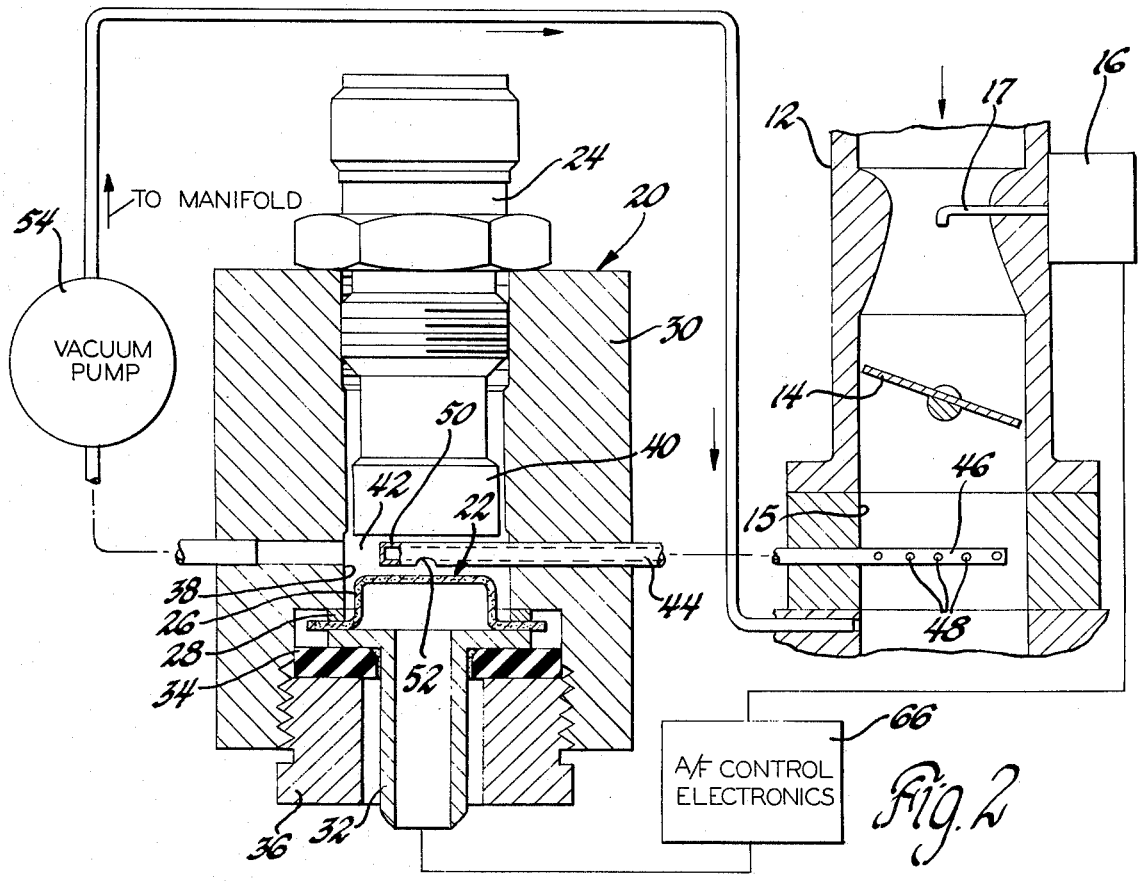
FIG. 2 is a view showing parts of the system in FIG. 1 with some in partial cross-section.

According to the present invention and rather than employing an air-fuel ratio sensor in the exhaust gas stream through the exhaust system 18, there is provided an air-fuel ratio sensing and heating unit 20 mounted on the engine near the induction system 12. As best shown in FIG. 2, the unit 20 comprises an air-fuel ratio sensor arrangement 22 and a heater 24 for heating the sensor and also heating and combusting an induction mixture sample as will be described in more detail later. The sensor unit is preferably of the zirconia cell type which senses the relative presence of oxygen in a combusted mixture and provides therefrom an electrical signal indicative of the air-fuel ratio of the inducted mixture. The use of these type sensors for sensing air-fuel ratio by sensing the relative presence of oxygen in the exhaust stream of an automobile engine is disclosed for example in U.S. Pat. Nos. 3,847,778 and 3,844,920 assigned to the assignee of the present invention. In the arrangement shown in FIG. 2, the air-fuel ratio sensor comprises a crucible shaped zirconia cell 26 that makes contact with the engine block through a copper gasket 28 and the metal housing 30 of unit 20 while the opposite side thereof contacts a center terminal 32 which is insulated by a ring 34 of insulating material for the engine block and from a retaining nut 36 which holds this assembly in place in housing 30. The zirconia cell 26 protrudes upwardly into the bottom of a bore 38 in the housing 30 while the heater 24 is threadably mounted in the upper end of the bore with its heater end 40 being in close proximity to the zirconia cell and leaving a relatively small space 42 therebetween. The heater 24 may be, for example, an electrically powered glow igniter such as commonly used in gas turbine engines, the heater 24 serving as both a heat source and ignition source in this case.

A fuel mixture sample conveying tube 44 has one end 46 with one or more inlet ports 48 which extends into the induction passage 15 just upstream of where the air-fuel mixture is being inducted into the engine. The other end 50 of the tube extends into the space 42 between the heater 24 and the air-fuel ratio sensor 22 and has an outlet port 52 which is in close proximity to and faces the upper surface of the zirconia cell 26. A vacuum pump 54 is connected to the space 42 and is ported back to the induction passage 15 downstream of the sampling inlet ports 48.

Operation of the vacuum pump causes a sample of the air-fuel mixture being inducted into the engine to be drawn through the tube inlet ports 48 and exhausted from the tube outlet port 52 against or in close proximity to the zirconia cell 26. Only a very small sample of the air-fuel mixture is taken and this is calibrated by making the length and the flow size of the tube 44 and its ports relatively small and its exit very close to the surface of the zirconia cell. In this way the transport delay is held to a minimum even with a small sample volume.

Furthermore, since the products of combustion of the sampling mixture are ported by the vacuum pump 54 back to the intake manifold, only a small differential pressure is required to move the sample rather than having to work against a high manifold vacuum were they ported to atmosphere. As a result, the vacuum pump can be relatively small and the return of the sensed gases to the intake manifold can perform a function similar to exhaust gas recirculation.

In system operation, electrical current from the vehicle's DC power supply 60 is passed through the heater 24 as soon as the car is started by simultaneous closure of a switch 62. With electrical current delivered thereto, the heater 24 warms up the zirconia cell 26 and also heats and ignites the air-fuel mixture sample as it is exiting toward the zirconia cell 26 from the tube outlet port 52. The degree of this heating may be fixed or it may be controlled by a current control unit 64 of conventional circuitry. The air-fuel ratio sensor's terminal 32 is connected to an electronic air-fuel (A/F) metering control unit 66 of conventional circuitry which is powered from the DC power supply also through closure of the switch 62 and delivers a control signal to the fuel control system 16. The electronic air-fuel ratio control 66 reads the signal from the air-fuel ratio sensor 22 and accordingly provides a command signal to the fuel control 16 to adjust, if need be, the air-fuel ratio of the fuel mixture to the stoichiometric value.

The above described embodiment is illustrative of the invention which may be modified within the scope of the appended claims.

I claim:

1. An air-fuel ratio control system for a throttled internal combustion engine comprising air-fuel ratio sensing means, means for supplying an unaltered sample of the throttled air-fuel mixture being inducted into said engine to said air-fuel ratio sensing means and then returning the sample for induction into the engine, ignition means for igniting the air-fuel mixture sample at said air-fuel ratio sensing means, and fuel system control means controlled by said air-fuel ratio sensing means for adjusting the fuel flow and thereby the air-fuel ratio of the mixture being inducted into the engine toward the stoichiometric value.

2. An air-fuel ratio control system for a throttled internal combustion engine comprising air-fuel ratio sensing means including a zirconia cell, means including a vacuum pump for directing an unaltered sample of the throttled air-fuel mixture being inducted into said engine toward said zirconia cell and then returning the sample for induction into the engine, heater-ignition means for heating said air-fuel ratio sensing means and also heating and igniting the air-fuel mixture sample at said zirconia cell, and fuel system control means controlled by said air-fuel ratio sensing means for adjusting the fuel flow and thereby the air-fuel ratio of the mixture being inducted into the engine toward the stoichiometric value.

* * * * *